US009031850B2

(12) United States Patent
Takada

(10) Patent No.: US 9,031,850 B2
(45) Date of Patent: May 12, 2015

(54) AUDIO STREAM COMBINING APPARATUS, METHOD AND PROGRAM

(75) Inventor: Yousuke Takada, Kobe (JP)

(73) Assignee: GVBB Holdings S.A.R.L., Luxembourg (LU)

( * ) Notice: Subject to any disclaimer, the term of this patent is extended or adjusted under 35 U.S.C. 154(b) by 498 days.

(21) Appl. No.: 13/391,262

(22) PCT Filed: Aug. 20, 2009

(86) PCT No.: PCT/JP2009/003968

§ 371 (c)(1),
(2), (4) Date: Jun. 19, 2012

(87) PCT Pub. No.: WO2011/021239

PCT Pub. Date: Feb. 24, 2011

(65) Prior Publication Data

US 2012/0259642 A1 Oct. 11, 2012

(51) Int. Cl.

| | |
|---|---|
| ***G10L 19/00*** | (2013.01) |
| ***G10L 19/022*** | (2013.01) |
| ***G10L 19/16*** | (2013.01) |
| *G10L 19/008* | (2013.01) |

(52) U.S. Cl.
CPC ..... *G10L 19/167* (2013.01); *G10L 19/008* (2013.01)

(58) Field of Classification Search
CPC . G10L 13/033; G10L 19/022; G10L 21/0316; G10L 21/0332; G10L 25/45; G10L 19/00; G10L 19/008; G10L 19/167
USPC ..... 704/278, 500, 501, 503, 504
See application file for complete search history.

(56) References Cited

U.S. PATENT DOCUMENTS

| | | | | |
|---|---|---|---|---|
| 5,913,190 | A * | 6/1999 | Fielder et al. | 704/229 |
| 6,718,309 | B1 * | 4/2004 | Selly | 704/503 |
| 2004/0186734 | A1 * | 9/2004 | Heo et al. | 704/278 |
| 2006/0047523 | A1 * | 3/2006 | Ojanpera | 704/503 |

(Continued)

FOREIGN PATENT DOCUMENTS

| | | |
|---|---|---|
| JP | 2001-142496 | 5/2001 |
| JP | 2003-052010 | 2/2003 |

OTHER PUBLICATIONS

International Search Report for International Application No. PCT/JP2009/003968, mailed Nov. 2, 2009, 1 page.

(Continued)

*Primary Examiner* — Martin Lerner
(74) *Attorney, Agent, or Firm* — Arent Fox LLP

(57) ABSTRACT

A stream combining apparatus is provided, comprising an input unit that receives the input of first group access units and second group access units from two streams that are generated by overlap transform; a decoder that generates group frames by decoding the group access units and that generates group frames by decoding the group access units; and a combining unit that uses first group frames and second group frames as a frame of reference for the access units, that decodes the frames, that performs selective mixing to generate mixed frames, that encodes said mixed frames, that generates a prescribed number of group access units, and that joins two streams, using a prescribed number of group access units as a joint such that the access units adjacent to each other on the boundary between the two streams and a prescribed number of group access units are stitched so that the information for decoding the same common frames is distributed.

18 Claims, 9 Drawing Sheets

(56) References Cited

U.S. PATENT DOCUMENTS

| | | | | |
|---|---|---|---|---|
| 2006/0080109 | A1* | 4/2006 | Kakuno et al. | 704/500 |
| 2006/0122823 | A1* | 6/2006 | Yoo | 704/200.1 |
| 2006/0187860 | A1* | 8/2006 | Li | 370/260 |
| 2008/0046236 | A1* | 2/2008 | Thyssen et al. | 704/228 |
| 2008/0262854 | A1* | 10/2008 | Jung et al. | 704/500 |
| 2008/0270143 | A1* | 10/2008 | Metz | 704/500 |
| 2010/0063825 | A1* | 3/2010 | Williams et al. | 704/500 |
| 2011/0196688 | A1* | 8/2011 | Jones | 704/503 |

OTHER PUBLICATIONS

International Preliminary Report on Patentability dated Mar. 13, 2012 and Written Opinion Opinion dated Nov. 2, 2009, regarding PCT/JP2009/003968.

Notice of Reasons for Rejection dated Dec. 3, 2013, regarding Japan Application No. JP 2011-527483.

Final Rejection dated Nov. 11, 2014 (and received in our office via email transmission Nov. 13, 2014), regarding Japanese Patent Application No. JP2011-527483.

* cited by examiner

// PASS THROUGH STREAM A $(U_0^C, U_1^C, \ldots, U_{N_A-M-1}^C) = (U_0^A, U_1^A, \ldots, U_{N_A-M-1}^A)$

// RE-ENCODE A-B MIXED FRAMES $(F_{N_A-M-1}^A, F_{N_A-M}^A, \ldots, F_{N_A-1}^A) = dec(U_{N_A-M-1}^A, U_{N_A-M}^A, \ldots, U_{N_A}^A)$ $(F_0^B, F_1^B, \ldots, F_M^B) = dec(U_0^B, U_1^B, \ldots, U_{M+1}^B)$ $(F_0^{AB}, F_1^{AB}, \ldots, F_{M-1}^{AB}) = mix((F_{N_A-M}^A, F_{N_A-M+1}^A, \ldots, F_{N_A-1}^A), (F_0^B, F_1^B, \ldots, F_{M-1}^B))$ $(U_{N_A-M}^C, U_{N_A-M+1}^C, \ldots, U_{N_A}^C) = enc(F_{N_A-M-1}^A, F_0^{AB}, F_1^{AB}, \ldots, F_{M-1}^{AB}, F_M^B)$

// PASS THROUGH STREAM B $(U_{N_A+1}^C, U_{N_A+2}^C, \ldots, U_{N_A+N_B-M}^C) = (U_{M+1}^B, U_{M+2}^B, \ldots, U_{N_B}^B)$

FIG. 9

AUDIO STREAM COMBINING APPARATUS, METHOD AND PROGRAM

CROSS-REFERENCE TO RELATED APPLICATION

This application is a United States National Stage Application under 37 CFR §371 of International Patent Application No. PCT/JP2009/003968, filed Aug. 20, 2009, which is incorporated by reference into this application as is fully set forth herein.

FIELD OF TECHNOLOGY

This invention is directed to an apparatus, a method, and a program that combines streams composed of compressed data; in particular, it relates, for example, to an apparatus, a method, and a program that combine audio streams that are generated by the compressing of audio data.

BACKGROUND TECHNOLOGY

In audio compression, audio signals are divided into blocks, each block composed of a prescribed number of data samples (hereinafter referred to as "audio samples"), and for each block the audio signals are converted to frequency signals that represent prescribed encoded frequency components, and audio compression data is generated. In encoding processing based on AAC (Advanced Audio Coding), in order to produce smooth audio compression data, the processing in which adjacent blocks are partially overlapped (hereinafter referred to as "overlap transform") is performed (see Non-Patent Reference 1, for example).

Further, audio streams composed of audio compression data require rate controls such as CBR (Constant Bit-Rate) and ABR (Average Bit-Rate) in order to satisfy buffer management constraints (see Non-Patent References 1 and 2, for example).

In audio editing, the editing of audio streams composed of audio compression data is frequently performed, and in some cases, such audio streams must be stitched together. Because audio compression data is generated by the partial overlap transform of blocks consisting of a prescribed number of audio samples, a simple joining of different audio streams produces frames in which data is incompletely decoded at joints of audio stream data, resulting in artifacts (distortions) in some cases. Further, simplistic joining of audio compression data can violate buffer management constraints, potentially resulting in buffer overflow or underflow. To prevent these issues, when joining different audio streams it was previously necessary to decode all audio streams and re-encode them.

On the other hand, there is an MPEG data storage method wherein image data encoded using the MPEG (Moving Picture Experts Group) coding method (hereinafter referred to as "MPEG image data") is re-encoded by limiting two identical sets of MPEG data to the joint of MPEG image data and the MPEG data is recorded in a storage medium (see Patent Reference 1). When joining two sets of different MPEG image data, this technique stores in memory information on the amount of space required in the VBV (Video Buffer Verifier) buffer in a prescribed segment and controls the VBV buffer based on this information to prevent a buffer overflow or underflow.

PRIOR ART REFERENCES

Patent References

Patent Reference 1: Laid-Open Patent Disclosure 2003-52010

Non-Patent References

Non-Patent Reference 1: ISO/IEC 13818-7:2006, "Information Technology—Generic Coding of Moving Pictures and Associated Audio—Part 7: Advanced Audio Coding (AAC)." 2006

Non-Patent Reference 2: M. Bost and R. E. Goldberg, "Introduction to Digital Audio Coding and Standards." Kluer Academic Publishers. 2003

SUMMARY OF THE INVENTION

Problems to be Solved by the Invention

As described above, when joining a plurality of different audio streams, re-encoding all audio streams is inefficient, and costly in time and computations, which is a problem.

Further, the MPEG data storage method disclosed in Patent Reference 1, while satisfying VBV buffer requirements, joins different MPEG image data by re-encoding them in a manner that limits the re-encoding process to joints; however, it does not solve the problem regarding the joining of compressed data that is generated by overlap transform.

Therefore, an objective of the present invention is to provide a stream combining apparatus, a stream combining method, and a stream combining program that smoothly join compressed data streams that are generated by overlap transform, without decoding all compressed data to audio frames and re-encoding them.

According to the first aspect of the present invention, the apparatus is an audio stream combining apparatus that generates a single audio stream by joining two audio streams composed of compressed data generated by overlap transform. If access units that are units of decoding of said two audio streams are designated as group 1 and group 2 access units, respectively; the frames that are produced by decoding said two audio streams are designated as group 1 and group 2 frames, respectively; and the access units that are produced by encoding the mixed frames that are generated by mixing said groups 1 and 2 frames are designated as group 3 access units, said audio stream combining apparatus provides a stream combining apparatus comprising: an input unit that receives the input of group 1 access units and group 2 access units; a decoder that generates group 1 frames by decoding the group 1 access units that were input by said input unit and that generates group 2 frames by decoding the group 2 access units; and a combining unit that uses group 1 frames and group 2 frames as a frame of reference for the access units, that decodes the frames, that performs selective mixing to generate mixed frames, that encodes said mixed frames, that generates a prescribed number of group 3 access units, and that joins two streams, using a prescribed number of group 3 access units as a joint such that the access units adjacent to each other on the boundary between the two streams and a prescribed number of group 3 access units are stitched so that the information for decoding the same common frames is distributed.

Because said stream is generated by overlap transform, of the access units that are units of decoding the individual frames, the two adjacent access units share information on the same frame that is common to the two access units. Therefore, essential to the correct decoding of a given frame are adjacent anterior and posterior access units that share and possess information on the frame. Previously, in the joining of different streams, the fact that, of the access units that act as units of decoding individual frames, the information necessary for the decoding of frames common to the adjacent two access units is distributed to the access units has never been focused on. For this reason, when an attempt is made to simply join different streams to one another, at the boundary between streams, the adjacent two access units end up possessing a part of the information for the decoding of different frames, rather than the information for the decoding of the same frames. As a consequence, incompletely decoded frames are produced from the two access units sharing the boundary, and the incompletely decoded frames result in artifacts. In the stream combining apparatus of the present invention, according to the constitution described above, the combining unit selectively mixes group 1 frames and group 2 frames, based on the access units that are used to decode the frames, to generate mixed frames; encodes said mixed frames; and generates group 3 access units that serve as a joint for the two streams; therefore, all compressed data is decoded into frames, and the need to encode them again (hereinafter referred to as "re-encoding") is eliminated. Further, because the combining unit, using a prescribed number of group 3 access units thus generated as a joint, performs the joining so that at the boundary between the two streams and a prescribed number of group 3 access units, the adjacent access units share the information for the decoding of the same common frames; therefore, even when not all compressed data is decoded into frames and re-encoded, a smooth joint free of any artifacts can be produced.

For example, in the stream combining apparatus of the present invention, said combining unit may include the following type of encoding unit: the encoding unit mixes a prescribed number of group 1 frames including the end frame, of said plurality of group 1 frames, and a prescribed number of group 2 frames including the starting frame so that the frames in said prescribed number of group 1 frames, excluding at least one frame from the beginning, and the frames in said group 2 frames, excluding at least one frame from the end frame, overlap one another; generates a larger number of mixed frames than said prescribed number; encodes said mixed frames, and generates a prescribed number of group 3 access units. Further, in the stream combining apparatus of the present invention, said combining unit may include the following type of joining unit: the joining unit joins said plurality of group 1 access units to said prescribed number of group 3 access units, so that of the plurality of access units employed to decode said prescribed number of group 1 frames, the starting access unit is adjacent to the starting access unit of said prescribed number of group 3 access units; and joins said plurality of group 2 access units to said prescribed number of group 3 access units, so that of the plurality of access units employed to decode said prescribed number of group 2 frames, the end access unit is adjacent to the end access unit of said prescribed number of group 3 access units.

By this constitution, the stream combining apparatus of the present invention can decode the group 1 access units and the group 2 access units in such a manner that they include a part of the access units that are output without re-encoding, generate groups 1 and 2 frames, respectively, and generate the group 3 access units that serve as a joint for two streams by mixing and re-encoding these groups 1 and 2 frames. When these group 3 access units are used as a joint, the information for decoding the same frame common to the streams, similar to the other parts that are encoded in the usual manner, is distributed to the two access units that are adjacent to each other at the boundary between the stream that is re-encoded and the stream that is not re-encoded; in this manner, the possibility of occurrence of incompletely decoded frames is eliminated. Consequently, even in situations where streams of different compressed data that are generated by overlap transform are to be joined to one another, smooth joining that is free of artifacts can be achieved, without the need to decode all compressed data to frames and to re-encode them. For this reason, it is possible to smoothly join any compressed data without decoding them to audio frames and re-encoding them.

Further, in the stream combining apparatus of the present invention, said encoding unit may encode said group 3 access units so that the initial buffer utilization amount of said prescribed number group 3 access units and its final buffer utilization amount match the buffer utilization amount of the starting part access units of the plurality of access units employed to decode said prescribed number of group 1 frames and the buffer utilization amount of end-part access units of the plurality of access units employed to decode said prescribed number of group 2 frames.

By this constitution, the stream combining apparatus of the present invention performs rate controls so that, in the group 1 access units and group 2 access units that constitute two streams, the buffer utilization amount of the starting access unit of the plurality of access units employed to decode a prescribed number of group 1 frames, which represent the end part of the group 1 access units that are joined without being re-encoded, and the buffer utilization amount of the second starting access unit from the end of the plurality of access units employed to decode a prescribed number of group 2 frames are equal, respectively, to the initial buffer utilization amount and the final buffer utilization amount of the re-encoded and generated group 3 access units; and by joining the streams by using the group 3 access units as a joint, the apparatus can make the buffer utilization amount of the combined stream change continuously. By using the group 3 access units as a joint, the apparatus can continuously maintain the buffer utilization amount between different streams that are rate-controlled separately, and can produce a combined stream in such a manner that buffer constraints on combined streams can be satisfied.

In the stream combining apparatus of the present invention, said combining unit may include a mixing unit that mixes said group 1 frames and said group 2 frames by cross-fading them.

By this constitution, the stream combining apparatus of the present invention, by using the group 3 access units as a joint, can even more smoothly join streams to one another.

According to a second aspect of the present invention the method is an audio stream combining method that generates one audio stream by joining two audio streams composed of compressed data that is generated by overlap transform. If the access units that serve as units of decoding of said two audio streams are designated as group 1 access units and group 2 access units, respectively; if the frames that are produced by decoding said two audio streams are designated as group 1 frames and group 2 frames, respectively; and if the access units that are produced by encoding the mixed frames that are generated by mixing said group 1 frames and said group 2 frames are designated as group 3 access units; said audio stream combining method comprises: an input step that inputs group 1 access units and group 2 access units; a decoding step that generates group 1 frames by decoding the group 1 access units that are input in said input step and that generates group 2 frames by decoding said group 2 access units;

and a combining step that selectively mixes said plurality of group 1 frames decoded in said decoding step and a plurality of group 2 frames, using the access units employed to decode the frames as a frame of reference, that generates a prescribed number of group 3 access units; and that joins said plurality of group 1 access units and said plurality of group 2 access units, such that, using said prescribed number of group 3 access units as a joint, the information for the decoding of the same common frames is shared by access units that are adjacent to one another across the boundary between said plurality of group 1 access units, said plurality of group 2 access units, and said prescribed number of group 3 access units.

According to a third aspect of the present invention, the program is an audio stream combining program that causes the computer to execute the processing of generating one audio stream by joining two audio streams composed of compressed data that is generated by overlap transform. If the access units that serve as units of decoding of said two audio streams are designated as group 1 access units and group 2 access units, respectively; if the frames that are produced by decoding said two audio streams are designated as group 1 frames and group 2 frames, respectively; and if the access units that are produced by encoding the mixed frames that are generated by mixing said group 1 frames and group 2 frames are designated as group 3 access units; said audio stream combining program comprises: an input step that inputs group 1 access units and group 2 access units; a decoding step that generates group 1 frames by decoding the group 1 access units that are input in said input step and that generates group 2 frames by decoding said group 2 access units; that selectively mixes said plurality of group 1 frames decoded in said decoding step and a plurality of group 2 frames, using the access units employed to decode the frames as a frame of reference; that generates a prescribed number of group 3 access units; and that joins said plurality of group 1 access units and said plurality of group 2 access units, such that, using said prescribed number of group 3 access units as a joint, the information for the decoding of the same common frames is shared by access units that are adjacent to one another across the boundary between said plurality of group 1 access units, said plurality of group 2 access units, and said prescribed number of group 3 access units.

Effects of the Invention

According to the present invention, streams of compressed data generated by overlap transform can be efficiently and smoothly joined without the need for re-encoding all compressed data.

BRIEF DESCRIPTION OF THE DRAWINGS

[FIG. 9] represents pseudo-code for the joining of stream A to stream B.

MODES OF EMBODIMENT OF THE INVENTION

The text below describes modes of embodiment of the present invention.

Mode of Embodiment 1

1. Summary of Stream Joining Processing

Figure 1:
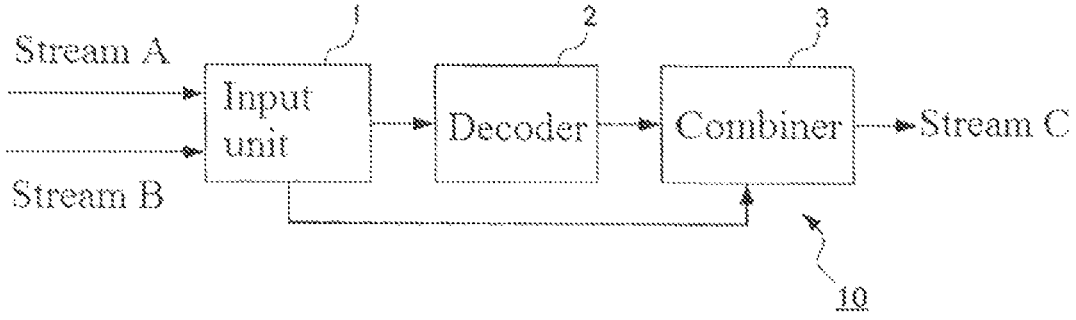
[FIG. 1] is a block diagram of the stream combining apparatus of Embodiment 1 of the present invention.

FIG. 1 is a schematic functional block diagram of a stream combining apparatus 10 of a representative mode of embodiment that executes the stream combining of the present invention. An explanation follows of the basic principles of the stream combining of the present invention using the stream combining apparatus 10 of FIG. 1.

The stream combining apparatus 10 comprises an input unit 1 that accepts the input of a first stream A and a second stream B; a decoding unit 2 that decodes the input first stream A and second stream B, respectively, and that generates group 1 frames and group 2 frames; and a combining unit 3 that generates a third stream C from the group 1 frames and group 2 frames. The combining unit includes an encoding unit (not shown) that re-encodes frames. Here, the individual frames that are produced by the decoding of the first and second streams, respectively, are referred to as "group 1 frames" and "group 2 frames".

Here, the first stream A and the second stream B are assumed to be streams of compressed data that is generated by performing overlap transform on frames obtained by sampling the signals and encoding the results.

Figure 2:
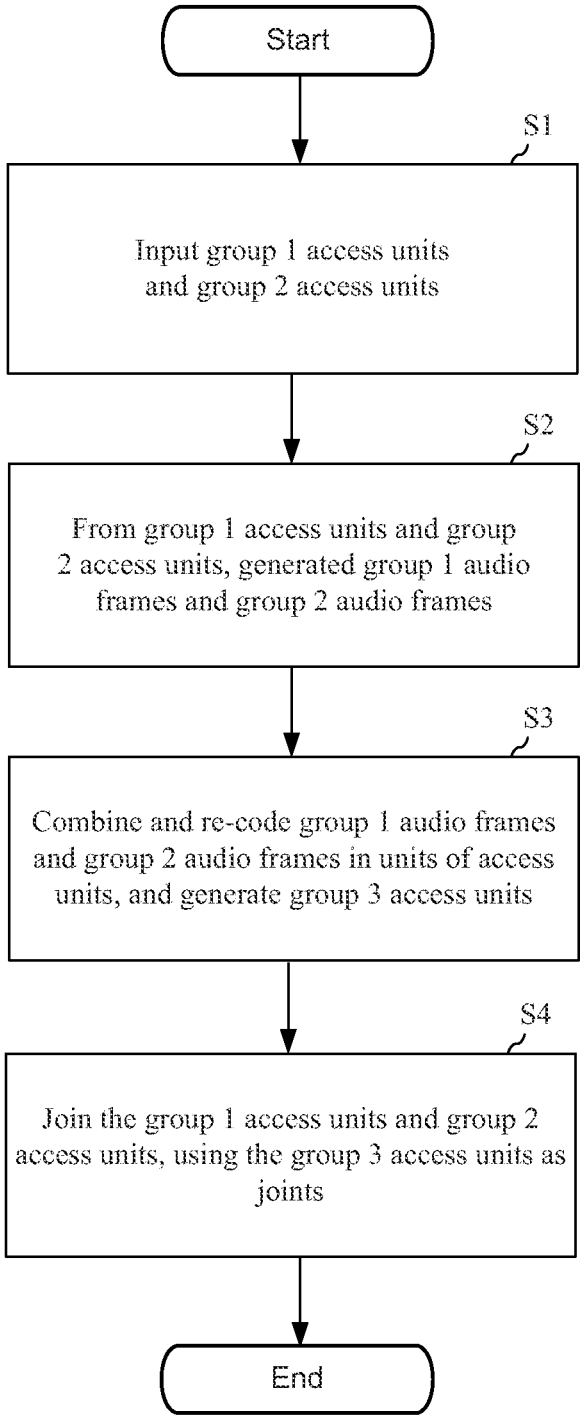
[FIG. 2] is a flowchart explaining the operation executed by the stream combining apparatus of FIG. 1.

FIG. 2 is a flowchart explaining the operation performed by the stream combining apparatus 10 in combining streams. Here, the basic unit of compressed data used to decode a frame is referred to as an "access unit". In this Specification, the set of individual access units that are units of decoding of the first stream A is referred to as "group 1 access units", the set of individual access units that are units of decoding of the second stream B is referred to as "group 2 access units", and the set of access units obtained by encoding the mixed frame generated by the mixing of the group 1 frames and the group 2 frames is referred to as "group 3 access units". Each processing is executed by controllers, such as the CPU (Central Processing Unit), which is not shown in the drawings, of the stream combining apparatus 10 and under the control of relevant programs.

In Step S1, the group 1 access units that constitute the first stream A and the group 2 access units that constitute the second stream B are input into the input unit 1, respectively.

In Step S2, the decoding unit 2, decoding the group 1 access units and the group 2 access units from the first stream A and the second stream B of the compressed data that is input into the input unit 1, generates group 1 frames and group 2 frames.

In Step S3, the combining unit 3, using the access units used to decode the individual frames as a frame of reference, selectively mixes the group 1 frames and the group 2 frames that are decoded by the decoding unit 2, generates mixed frames, encodes said mixed frames, and generates a prescribed number of group 3 access units.

In Step S4, using the prescribed number of group 3 access units thus generated as a joint, the two steams are joined in such a manner that the access units that are adjacent to one another at the boundary between the two streams and the prescribed number of group 3 access units share the information for the decoding of the same common frames.

Thus, because the combining unit 3, based upon the access units that are used to decode the individual frames, selectively mixes the group 1 and 2 frames, encodes the mixed frames, and generates group 3 access units that serve as a joint for the two streams, it is not necessary to decode all compressed data into frames and re-encode them (hereinafter referred to as "re-encoding"). Further, because the combining unit, using the prescribed number of group 3 access units thus generated as a joint, joins the two steams in such a manner that the access units that are adjacent to one another at the boundary between the two streams and the prescribed number of group 3 access units share the information for the decoding of the same common frames, even without decoding all compressed data into frames and re-encoding them, smooth joints free of artifacts can be produced.

Here, the combining unit 3 may include the following type of encoding unit: an encoding unit that mixes a plurality of group 1 frames and a plurality of group 2 frames in such a manner that, of the contiguous group 1 frames, a prescribed number of group 1 frames including the end frame, and of the contiguous group 2 frames, a prescribed number of group 2 frames including the starting frame, overlap one another, with the exception of one or more frames from the starting frame of the prescribed number group 1 frames and with the exception of one or more frames from the end of the prescribed number of group 2 frames, thereby generating mixed frames greater in numbers than the prescribed number; that encodes said mixed frames, and that generates a prescribed number of group 3 access units.

Further, the combining unit 3 may include the following type of joining unit: a joining unit that stitches contiguous group 1 access units to the head of a prescribed number of group 3 access units, using, of the plurality of access units used to decode the prescribed number of group 1 frames, the starting access unit as a joint; and that stitches contiguous group 2 access units to the end of the prescribed number of group 3 access units, using the end access unit, as a joint, of the plurality of access units used to decode the prescribed number of group 2 frames.

Further, the aforementioned encoding unit may encode said group 3 access units so that the initial buffer utilization amount of said prescribed number group 3 access units and its final buffer utilization amount match the buffer utilization amount of the starting part access units of the plurality of access units employed to decode said prescribed number of group 1 frames and the buffer utilization amount of end-part access units of the plurality of access units employed to decode said prescribed number of group 2 frames.

By this constitution, the stream combining apparatus of the present invention performs rate controls so that, in joining the group 1 access units and group 2 access units that constitute two streams to group 3 access units, the buffer utilization amount of the end access unit of the group 1 access units that are joined to the head of group 3 access units without being re-encoded, and the buffer utilization amount of the end access unit from the end of the group 2 access units that re re-encoded and substituted for group 3 access units are equal, respectively, to the initial buffer utilization amount and the final buffer utilization amount of the re-encoded and generated group 3 access units; and in this manner the apparatus can make the buffer utilization amount of the combined stream change continuously. By using the group 3 access units as a joint, the apparatus can continuously maintain the buffer utilization amount between different streams that are rate-controlled separately, and can produce a combined stream in such a manner that buffer constraints on combined streams can be satisfied.

A detailed description follows of the stream joining processing executed by the stream combining apparatus 10.

2. Principles of Stream Joining Processing

The following is a description of the underlying principles of the stream joining method of the present invention, taking as an example audio compressed data that is generated according to the AAC coding standard.

In AAC coding processing, audio frames that are blocked in 1024 samples each are created, and the audio frames are used as units of encoding or decoding processing. Two adjacent audio frames are converted to 1024 MDCT coefficients by MDCT (Modified Discrete Cosine Transform) using either one long window with a window length of 2048 or eight short windows with a window length of 256. The 1024 MDCT coefficients that are generated by MDCT are encoded by ACC coding processing, generating compressed audio frames or access units. The set of audio samples that is referenced during MCDT transform and that contributes to the MDCT coefficients is referred to as an MDCT block. For example, in the case of a long window with a window length of 2048, the adjacent two audio frames constitute one MDCT block. MDCT transform being a type of overlap transform, all two adjacent windows that are used in MDCT transform are constructed so that they mutually overlap. In AAC, two window functions, a Sine window, and a Kaiser-Bessel derived window, of different frequency characteristics are employed. The window length can be switched according to the characteristic of the audio signal that is input. In what follows, unless noted otherwise, the case where one window function with a long window length of 2048 is employed is explained. Thus, compressed audio frames or access units that are encoded and generated by the AAC encoding processing of audio frames are generated by overlap transform.

Figure 3:
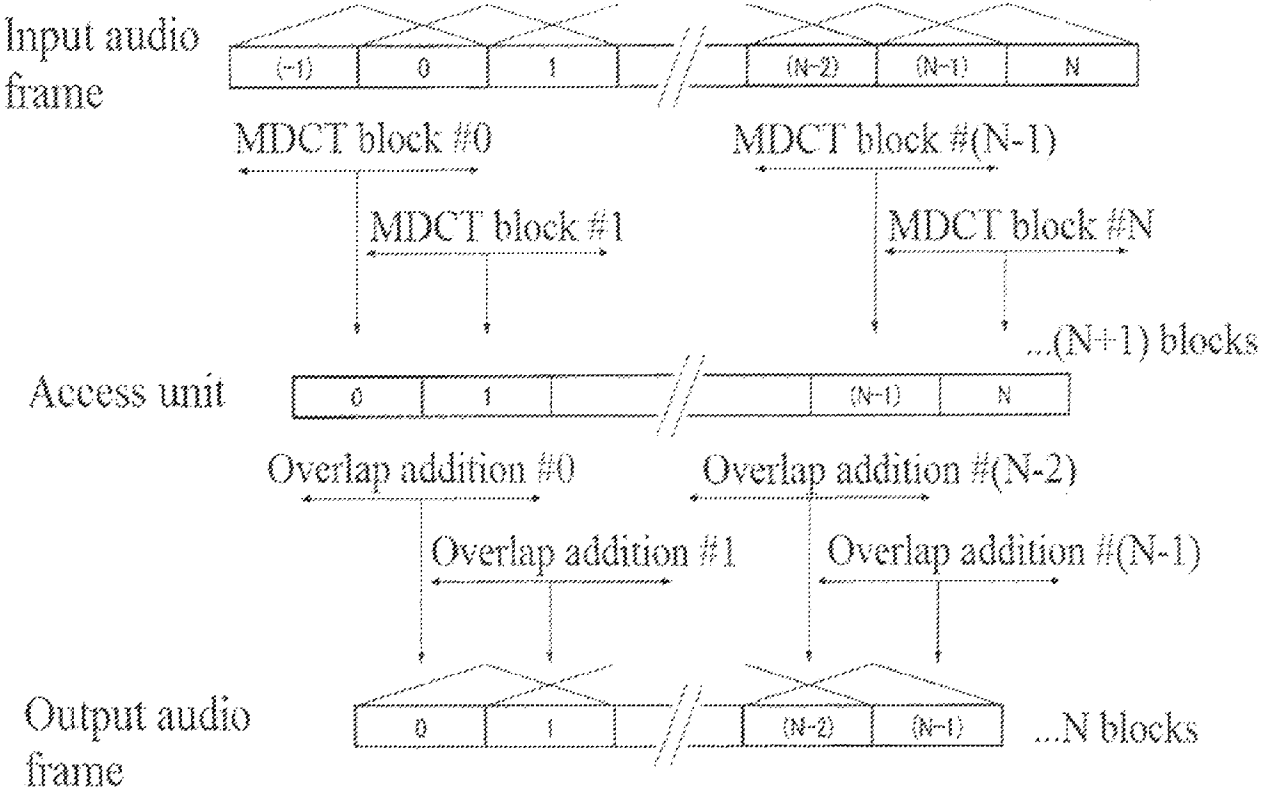
[FIG. 3] depicts the relationship between audio frames and access units.

First, FIG. 3 shows the relationship between audio frames and access units. Here, the audio frame represents 1024 audio samples that are obtained by sampling audio signals, and the access unit is defined as the smallest unit of an encoded stream or audio compressed data for the decoding of one audio frame. In FIG. 3, access units are not drawn to scale corresponding to the amount of encoding (the same is true for the rest of the document). Due to overlap transform, audio frames and access units are related to one another in such a manner that one is 50% off the other by the frame length.

As shown in FIG. 3, if i denotes any integer, the access unit i is generated from an MDCT block #i composed of input audio frames (i−1) and i. The audio frames is reproduced by the overlap addition of MDCT blocks #i and #(i+1) containing an aliasing decoded from the access units i and (i+1). Since the input audio frames (−1) and N are not output, the contents of these frames are arbitrary; all samples can be 0, for example.

As shown in FIG. 3, if N denotes any integer, it is clear that for overlap transform, in order to produce N audio frames, that is, the output audio frames, it is necessary to input (N+2) audio frames into the encoding unit. In this case, the number of access units generated will be (N±1).

Figure 4:
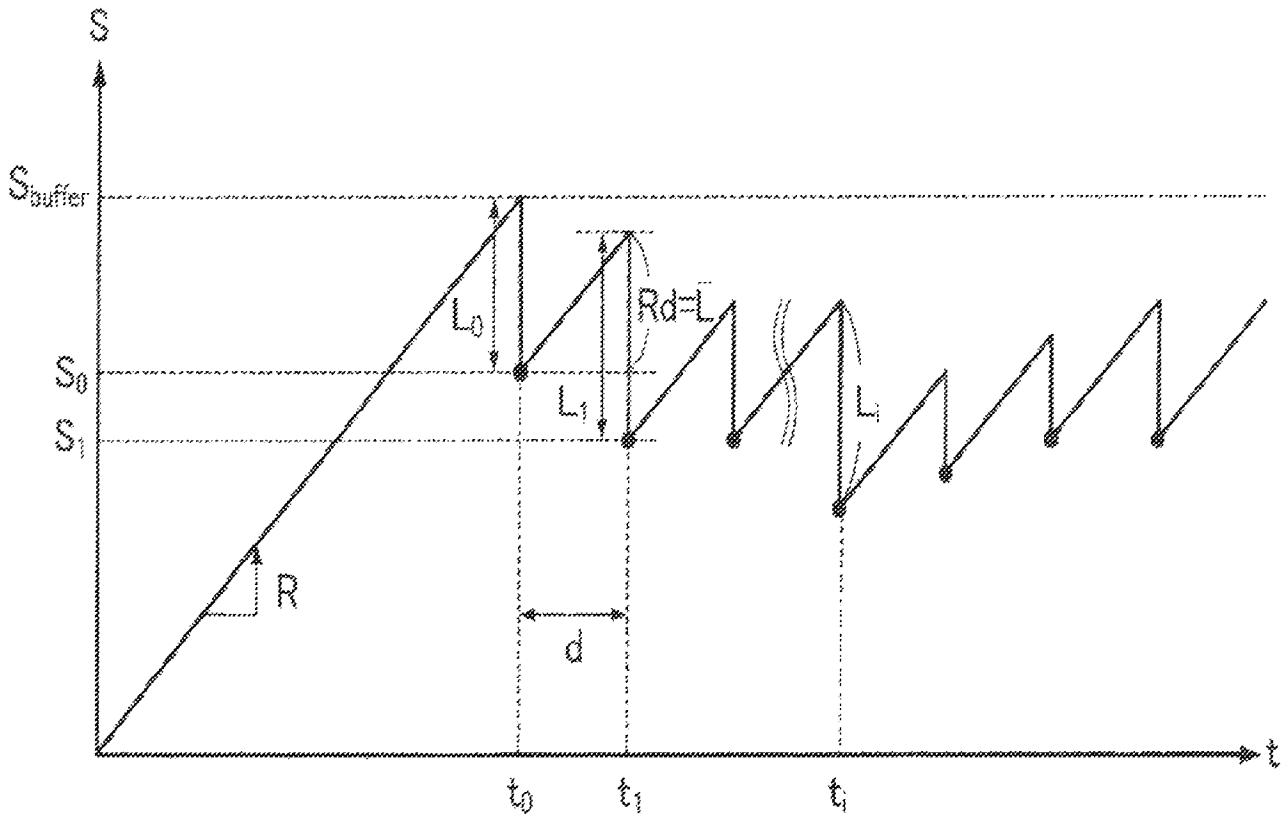
[FIG. 4] describes the conditions of the buffer.

FIG. 4 shows the condition of the buffer in the decoding unit when the rate control necessary to satisfy the ABR (average bit rate) is performed. The decoding unit buffer, which temporarily accumulates data up to a prescribed coding amount and which adjusts the bit rate by simulation, is also called a bit reserver.

The bit stream is successively transmitted to the decoding unit buffer at a fixed rate, R. For ease of understanding, let us assume that when the access unit i is decoded, the code for the access unit i is removed instantly, and a frame (i−1) is output instantly, where i denotes any integer. It should be noted, however, that because an overlap transform is performed, no audio frames are output when the first access unit is decoded.

If d is the interval at which decoding is executed and $f_s$ denotes a sampling frequency, the interval $d=1024/f_s$ can be written down. If the average amount of coding per access unit is L (with an upper score), the average amount of coding can be expressed as L (with an upper score)=Rd by multiplying the fixed rate R by the decoding execution interval d.

Adequate rate control is guaranteed if, given any input into the encoding unit, the amount of coding for an access unit can be controlled to be less than the average encoding amount L (with an upper score). Unless noted otherwise, in the following discussion we assume that rate control is guaranteed at a prescribed rate.

If the amount of coding for an access unit is $L_i$ and if the buffer utilization amount after the access unit i is removed from the buffer is defined as the buffer utilization amount $S_i$ at the access unit i, using $S_{i-1}$ and $L_i$, the $S_i$ can be expressed as follows:

[Eq. 1]

$$S_i=S_{i-1}+\overline{L}-L_i \quad \text{(Eq. 1)}$$

If the size of the decoding unit buffer is $S_{buffer}$, the maximum buffer utilization amount can be expressed as $S_{max}=S_{buffer}-L$ (with an upper score). In order to guarantee that the buffer will not overflow or underflow, it suffices to control the coding amount $L_i$ so that Eq. (2) is satisfied. The coding amount $L_i$ is controlled in units of byte, for example.

$$0\leq S_i\leq S_{max} \quad \text{[Eq. 2]}$$

Obviously, in order for the above formula to hold, it is necessary that $0\leq S_{max}$. When encoding a given stream, in order to calculate the buffer utilization amount $S_0$ for the first access unit, given Eq. (1), the quantity $S_{-1}$, (hereinafter referred to as the "initial utilization amount" for the buffer) is required. $S_{-1}$ can be any value that satisfies Eq. 2. If $S_{-1}=S_{max}$, it means that the decoding of the stream is started when the buffer is full. $S_{-1}=0$ means that the decoding of the buffer is started when the stream is empty. In the example in FIG. 4, it is assumed that $S_{-1}=S_{max}$.

Consequently, in the stream combining apparatus of FIG. 1, the combining unit 3 can perform encoding in such a manner that the buffer utilization amount of the access units in the output audio frames, that is, the group 3 access units, is greater than or equal to zero and less than or equal to the maximum buffer utilization amount. In this manner, the problem of buffer overflow or underflow can be prevented reliably.

In what follows, unless noted otherwise, it is assumed that the condition $0\leq S_{max}$ is met.

Returning to FIG. 4, if the buffering is started at the time t=0, the time $t_0$ when the first access unit to be decoded is decoded can be expressed as follows, where the access unit 0 is the first access unit to be decoded, not necessarily the starting access unit in the stream:

[Eq. 3]

$$t_0=(S_0+L_0)/R \quad \text{Eq. (3)}$$

It is also assumed that the information $S_i$ and coding amount $L_i$ is stored in the access unit. In the following explanation, it is assumed that the access unit is in the ADTS (Audio Data Transport Stream) format, and that the quantization value $S_i$ and the value coding amount $L_i$ are stored in the ADTS header of the access unit i. With respect to a given ADTS stream, it is assumed that the transmission bit rate R and the sampling frequency $f_s$ are known.

Next, we explain the processing wherein a stream C is generated by combining streams A and B. First, we provide a detailed description of the generation and re-encoding of the joint frame (hereinafter referred to as the "joint frame") that serves as a joint when streams A and B are stitched together.

Figure 5:
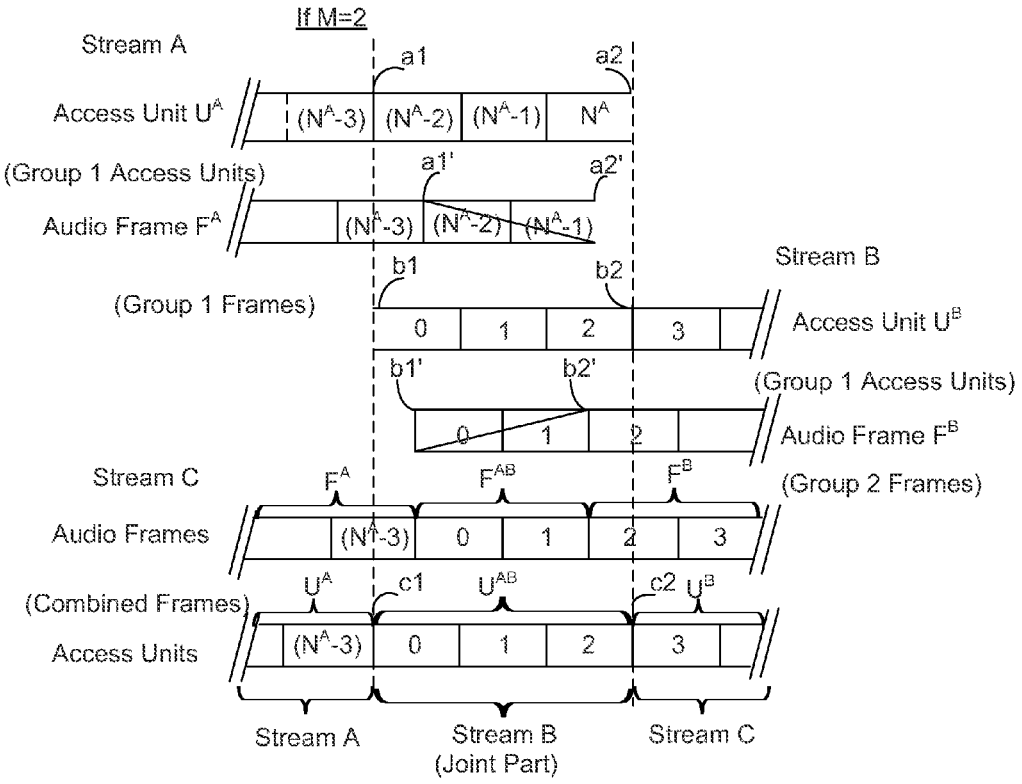
[FIG. 5] shows an example of joining stream A to stream B.

FIG. 5 shows an example where streams A and B are joined. In the example in FIG. 5, streams A and B are joined using a stream AB which is generated by the partial re-encoding of streams A and B, and a stream C is generated. Here, of the access units in stream A or B that are output to stream C without being re-encoded are referred to as "non-re-encoded access units." Further, of the access units in stream A or B, the access units that are substituted for re-encoded access units in stream C and corresponding to the joined stream are referred to as "access units to be re-encoded". It should be noted that the access units that constitute stream A correspond to group 1 access units; the access units that constitute stream B correspond to group 2 access units; and the access units that constitute stream AB correspond to group 3 access units.

The numbers of audio frames that are produced by the decoding of streams A and B are set to $N^A$ and $N^B$ respectively. Stream A is composed of $N^A+1$ access units, $U^A[0]$, $U^A[1]$, . . . , $U^A[N^A]$. Decoding them produces $N^A$ audio frames, $F^A[0]$, $F^A[1]$, . . . , $F^A[N^A-1]$. Stream B is composed of $N^B+1$ access units, $U^B[0]$, $U^B[1]$, . . . , $U^B[N^B]$. Decoding them produces $N^B$ audio frames, $F^B[0]$, $F^B[1]$, . . . , $F^B[N^B-1]$. FIG. 5 shows the manner in which streams A and B are arranged so that the trailing 3 access units in stream A and the leading 3 access units in stream B overlap. The overlapping 3 access units, that is, $U^A[N^A-2]$, $U^A[N^A-1]$, $U^A[N^A]$ that are in the range for which a1 and a2 in stream A form a boundary, and $U^B[0]$, $U^B[1]$, $U^B[2]$ that are in the range for which b1 and b2 in stream B form a boundary, are access units to be re-encoded; any other access units in streams A and B are non-re-encoded access units. The access units to be re-encoded are substituted by the joint access units $U^{AB}[0]$, $U^{AB}[1]$, $U^{AB}[2]$. Joint access units can be obtained by encoding the joint frames.

Frames at the joint can be produced by mixing the 3 frames $F^A[N^A-3]$, $F^A[N^A-2]$, and $F^A[N^A-1]$ obtained by decoding the consecutive four access units $U^A[N^A-3]$, $U^A[N^A-2]$, $U^A[N^A-1]$, and $U^A[N^A]$, that include the end access units in stream A; and the three frames $F^B[0]$, $F^B[1]$, and $F^B[2]$ obtained by decoding the consecutive four access units $U^B[0]$, $U^B[1]$, $U^B[2]$, and $U^B[3]$, that include the starting access units in stream B, so that the two frames indicated by the slanted lines in FIG. 5 overlap, that is, so that $F^A[N^A-2]$ overlaps $F^B[0]$, and so that $F^B[N^A-1]$ overlaps $F^B[1]$.

If $F^{AB}[0]$ and $F^{AB}[1]$ denote, respectively, the frames in which $F^A[N^A-2]$ is mixed with $F^B[0]$ and $F^A[N^A-1]$ is mixed with $F^B[1]$, the frames at the joint, in time sequence, will be $F^A[N^A-3]$, $F^{AB}[0]$, $F^{AB}[1]$, $F^B[2]$. By encoding these four joint frames, we obtain three access units $U^{AB}[0]$, $U^{AB}[1]$, $U^{AB}[2]$. Let us now focus on the non-re-encoded access unit and the re-encoded access unit that are adjacent to each other across the boundary c1, c2.

Because the audio frames $F^A[N^A-3]$, $F^A[N^A-2]$, and $F^A[N^A-1]$ of stream A and the audio frames $F^B[0]$-$F^B[2]$ of stream B are generated by overlap transform, during re-encoding, the parts that are mixed by overlapping and re-encoded, that is, the parts that can be decoded only from the access units $U^A[N^A-2]$-$U^A[N^A]$ of stream A and the access units $U^B[0]$-$U^B[2]$ of stream B, are limited to the part that is delimited by tips a1', b1' and ends a2, b2'. In addition, the sampling frequencies of streams A and B are defined as R and $f_s$, respectively, they are assumed to be common to both streams, and their average encoding amount L (with an upper score) per access unit is also assumed to be equal.

Parameters for window functions can be set appropriately and re-encoded so that there will be no discontinuity with regard to the lengths (2048 and 256) of the window functions and their forms (sine window and Kaiser-Bessel-derived window) between the non-re-encoded access unit $U^A$ [$N^A$−3] and the joint access unit $U^{AB}$ [0] that is adjacent to the former across the boundary c1, and between the joint access unit $U^{AB}$ [2] and the non-re-encoded access unit $U^B$ [3] that is adjacent to the former across the boundary c2. However, in many cases the discontinuity of window functions is allowed, given that discontinuous window functions are allowed in the standard and the occurrence of discontinuity is rare due to the fact that most access units employ long windows.

Further, for the smooth joining of audio items, mixed frames $F^{AB}$ [0] and $F^{AB}$ [1] can be generated by cross-fading at the joint frame between streams A and B.

The following is an explanation of a generalized case. It is assumed that when streams A and B are combined, mixing (cross-fading) is performed so that M audio frames counted from the end of stream A and M audio frames counted from the beginning of stream B overlap.

In concrete terms, in consideration of overlap transform, (M+1) access units counted from the end of stream A and (M+1) access units counted from the beginning of stream B are deleted, new (M+1) access units are generated at the joint, and streams A and B are joined. In order to generate (M+1) access units, M frames subject to cross-fading and one anterior frame and one posterior frame (total: (M+2)) are re-encoded. In the example in FIG. 5, it is assumed that M=2.

The length of cross-fading can be arbitrary. Although an explanation was given assuming that M=2, the present invention is by no means limited to such a case; M can be 1 or 3 or greater. When combining streams, the number of audio frames to be cross-faded or the number of access units to be re-encoded can be determined based upon the streams to be combined. Here, streams A and B are combined and cross-faded, creating a combined stream C. In concrete terms, while gradually reducing the volume of stream A (fading the stream A out) and while gradually increasing the volume of stream B (fading the stream B in), streams A and B are combined, creating a stream C. This invention, however, is not limited to this case. Streams can be combined using any technique, provided that streams are combined in units of access units while remaining within the bounds of buffer management constraints, to be described in detail later.

Also, by setting M=0, the audio frames of stream A and those of stream B can be stitched together directly. Also in this case, streams A and B can be combined in such a manner as to prevent the occurrence of frames that are incompletely decoded.

In reference to the header ADTS, the initial buffer utilization amount of the (M+1) access units to be re-encoded and the buffer utilization amount of the final access unit can be restored with a prescribed accuracy. The text below explains the relationship between the joining of streams and the buffer states in the present mode of embodiment.

Figure 6:
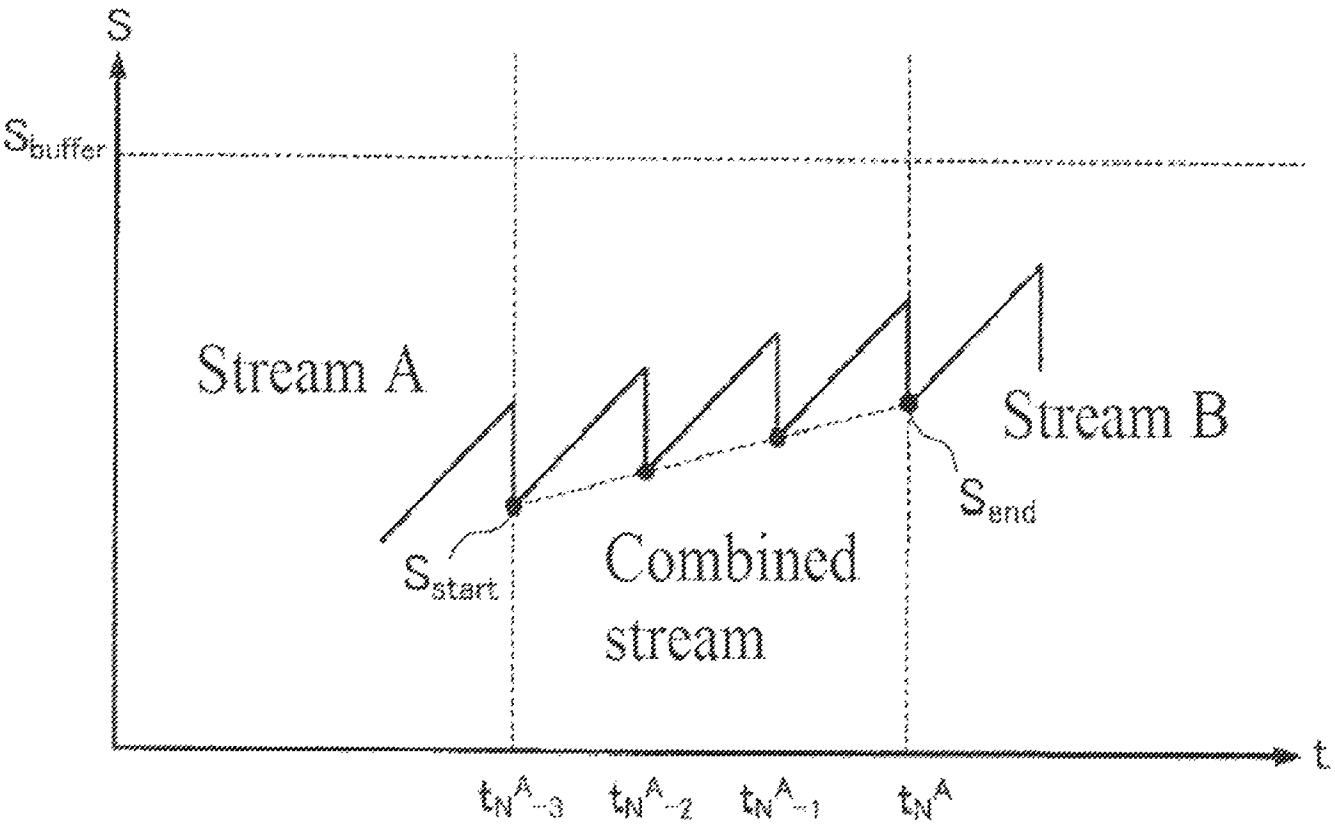
[FIG. 6] describes the conditions of the buffer.

FIG. 6 shows the buffer condition when streams are joined in the present mode of embodiment. In the present mode of embodiment, streams are joined so that the buffer condition for the non-re-encoded stream and the buffer condition for the re-encoded stream are continuous. Specifically, the initial buffer utilization amount $S_{start}$ for the re-encoded combined stream and the end buffer utilization amount $S_{end}$ are made equal, respectively, to the buffer utilization amount of the last access unit $U^A$ [$N^A$−3] of stream A that is not re-encoded and the buffer utilization amount of the last access unit $U^B$ [2] of the last access unit of stream B that is re-encoded. In this example, approximately the same amount of code is assigned to the three access units $U^{AB}$ [0], $U^{AB}$ [1], and $U^{AB}$ [2], which is equivalent to performing CBR rate control. In this manner, two streams can be joined while avoiding buffer overflow or underflow.

Further, any method can be employed to allocate the amount of code to re-encoded access units. For example, the amount of code to be assigned can be varied to ensure constant quality. Whereas in the example in FIG. 5, during the combining of streams A and B, the (M+1) access units where streams A and B overlap are substituted with re-encoded, that is, stream AB containing (M+1) access units at the joint, the present invention is by no means limited to this example; in stream A or B, more access units than the number (M+1) can be re-encoded.

Since streams are generated by overlap transform, decoding an audio frame from a stream requires two adjacent access units to which the information for the decoding of the audio frame is distributed. Previously, for the joining of streams, although a smooth joining in the temporal region of audio signals was considered important, little attention has been paid to the access units necessary for the decoding of audio frames. For example, in the example in FIG. 5, the decoding of frame $F^A$ [$N^A$−3] requires access units $U^A$ [$N^A$−3] and $U^A$ [$N^A$−2]. Missing either access unit $U^A$ [$N^A$−3] or $U^A$ [$N^A$−2], the decoding of frame $F^A$ [$N^A$−3] can be incomplete. Incompletely decoded frames can result in artifacts.

Focusing on this fact, for the re-encoding and generating of access units that constitute a joint, the present invention provides that the information necessary for the decoding of frames common to the access units is distributed to two adjacent access units: one that is not re-encoded and one that is re-encoded. Specifically, in the stream combining apparatus 10 of FIG. 1, the combining unit 3 generates group 1 frames composed of (M+1) frames by decoding the (M+2) contiguous access units including the end access unit of group 1 access units; generates group 2 frames composed of (M+1) frames by decoding the (M+2) contiguous access units including the starting access unit of group 2 access units; mixes said group 1 frames and said group 2 frames so that one or more starting frames and one or more end frames do not overlap one another and so that only M frames overlap one another; generates third frames composed of (M+2) frames; and generates group 3 access units by encoding the third frames. The combining unit generates a combined stream C by joining, in the indicated order, contiguous access units including the head of group 1 access units including the first access unit of the access units decoded from group 1 frames, and contiguous access units including the end of group 2 access units including the end of the access units decoded from group 2 frames. For this reason, even if the stream of compressed data is a stream generated by overlap transform, information for the decoding of the same frame common to them, similar to the ordinary decoding process, is distributed to the two access units that are adjacent across the boundary between the re-encoded stream and the non-re-encoded stream, thereby eliminating the possibility of occurrence of artifacts at the joint. Consequently, different streams can be joined smoothly without the need for decoding all compressed data into audio frames and re-encoding them. Further, by cross-fading the streams to be joined together, smoother joints can be created.

Thus, the stream combining apparatus of the present mode of embodiment comprises an input unit 1 that receives the input, respectively, of contiguous group 1 access units and group 2 access units from two streams composed of compressed data generated by overlap transform; a decoding unit 2 that generates contiguous group 1 frames by decoding contiguous group 1 access units and generates contiguous group 2 frames by decoding contiguous group 2 access units that; and a combining unit 3 that selectively mixes contiguous group 1 frames and contiguous group 2 frames, based on the access units that are used to decode the frames, to generate mixed frames; encodes said mixed frames; and generates a prescribed number of group 3 access units that serve as a joint for the two streams; therefore, all compressed data is decoded into frames, and the need to encode them again (hereinafter referred to as "re-encoding") is eliminated. Further, the combining unit, using a prescribed number of group 3 access units thus generated as a joint, performs the joining so that at the boundary between the two streams and a prescribed number of group 3 access units the adjacent access units share the information for the decoding of the same common frames; therefore, even when not all compressed data is decoded into frames and re-encoded, a smooth joint free of any artifacts can be produced; such that from each stream exclusively a prescribed number of access units are extracted, and a group 3 access units is generated by mixing and re-encoding the head and the end of each stream. By using the group 3 access units as a joint, the possibility is eliminated of the occurrence of incompletely decoded frames even when streams of different compressed data generated by overlap transform are to be joined. Consequently, a smooth joint free of artifacts can be achieved without the need for decoding all compressed data into frames and re-encoding them.

As explained above, in the stream combining apparatus 10 of the present mode of embodiment, contiguous group 1 access units and contiguous group 2 access units as streams A and B that are input into the input unit 1 are decoded by the decoding unit 2, and contiguous group 1 frames and contiguous group 2 frames are generated. The combining unit 3, based upon the access units that are used to decode the frames, selectively mixes the contiguous group 1 frames and contiguous group 2 thus decoded, and generates mixed frames, encodes said mixed frames, and generates group 3 access units that provide a joint for the two streams. Therefore, the need for decoding all compressed data into frames and re-encoding them, that is, the re-encoding step, is eliminated. Further, the combining unit, using a prescribed number of group 3 access units thus generated as a joint, performs the joining so that at the boundary between the two streams and a prescribed number of group 3 access units the adjacent access units share the information for the decoding of the same common frames; therefore, even when not all compressed data is decoded into frames and re-encoded, a smooth joint free of any artifacts can be produced.

Although the above is a detailed description of the stream combining apparatus in the basic mode of embodiment of the present invention, the present invention is by no means limited to such a specific mode of embodiment; it can be altered and modified in various ways. Whereas in the present mode of embodiment an example was provided of using audio compressed data generated according to AAC, the present invention is by no means limited to this technique; it is applicable to streams generated by various methods of encoding, such as MPEG Audio and AC3 encoding, provided that the data is compressed data generated by overlap transform.

Mode of Embodiment 2

Figure 7:
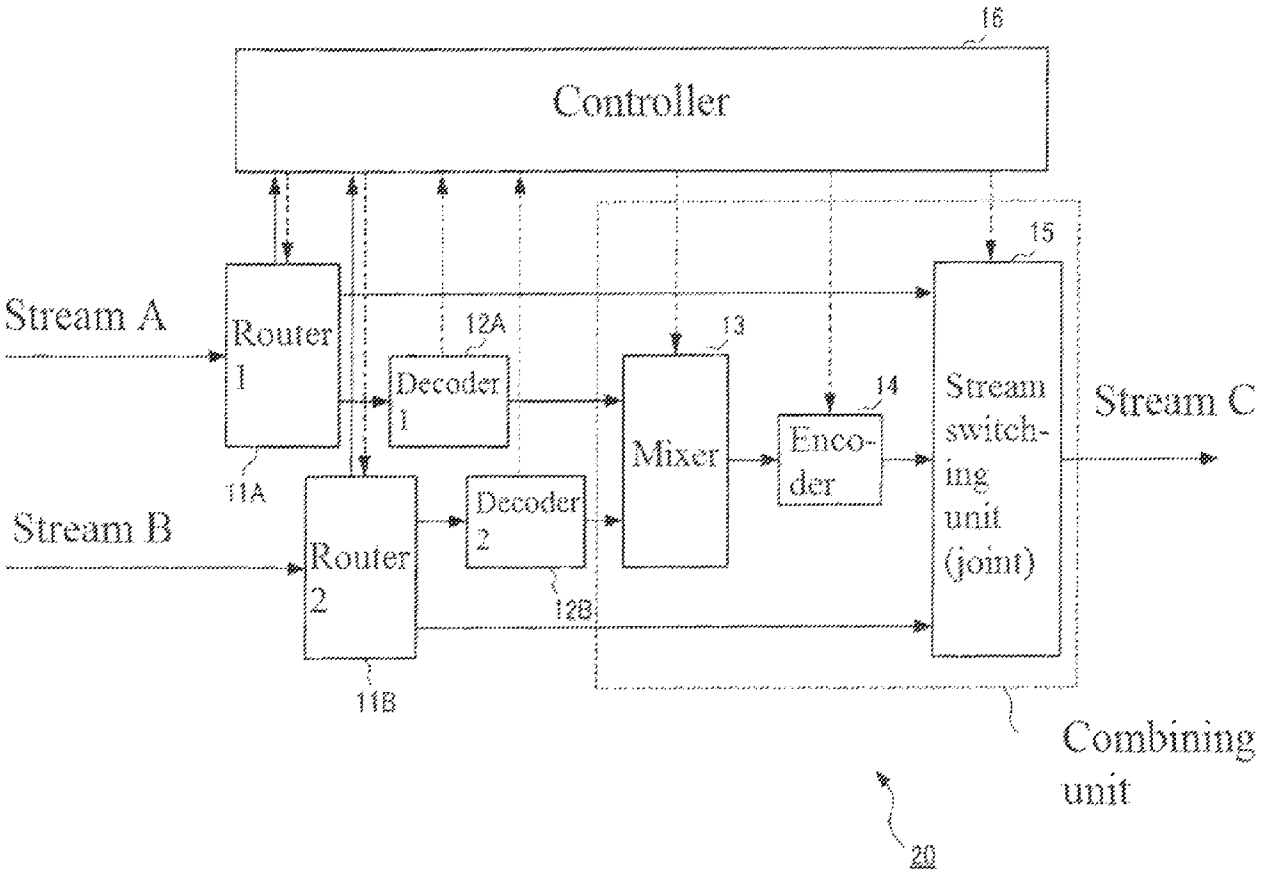
[FIG. 7] is a block diagram of the stream combining apparatus of Embodiment 2 of the present invention.

FIG. 7 is a block diagram of the stream combining apparatus of mode of embodiment 2.

As shown in FIG. 7, the stream combining apparatus 20 of the present mode of embodiment comprises: a first router unit 11A that outputs the input first stream A, by access unit, to a stream switching unit or the first decoding unit; a second router unit 11B that outputs a second stream B, by access unit, to the second decoding unit or a stream switching unit; a first decoding unit 12A that generates group 1 frames by decoding the access units that are input from the first router unit 11A; a second decoding unit 12B that generates group 2 frames by decoding the access units that are input from the second router unit 11B; a mixing unit 13 that generates joint frames by mixing the group 1 frames that are generated in the first decoding unit 12A and the group 2 frames that are generated by the second decoding unit 12B; an encoding unit 14 that encodes the joint frames generated by the mixing unit 13 and that generates joint access units; a stream switching unit 15 that switches and outputs, as necessary, the access units in the first stream A that is input from the first router 11A, the joint access units generated in the encoding unit 14, and the access units in the second stream B that is input from the second router unit 11B; and a control unit 16 that controls the first router unit 11A, the second router unit 11B, the first decoding unit 12A, the second decoding unit 12B, the mixing unit 13, the encoding unit 14, and the stream switching unit 15. It should be noted that the principles of stream joining processing executed by the stream combining apparatus 20 are the same as those of the stream combining apparatus 10 mode of embodiment 1; therefore, a detailed explanation of stream joining processing is omitted. The stream switching unit 15 constitutes the joining unit of the present invention.

Here, streams that are input into the stream combining apparatus of this mode of embodiment are not limited to streams composed of audio compressed data generated according to the AAC standard; they can be any compressed data streams generated by overlap transform.

The control unit 16, based upon control parameters that are input by a user, determines the method for cross-fading and the number of frames for cross-fading to be employed. Further, the control unit, receiving the input of streams A and B, acquires the lengths of streams A and B, that is, the number of access units involved. In addition, if the stream is in Audio Data Transport Stream (ADTS) format, the control unit acquires the buffer state of each access unit, such as the utilization rate, from the ADTS header of the access unit. However, in situations where it is not possible to directly obtain the buffer states of the access units, the control unit acquires the required information by simulating the decoder buffer and other techniques.

The control unit 16, from the numbers of access units in streams A and B and from the conditions of stream A and B buffers, identifies the access units to be re-encoded, and determines the coding amount and other items on the access units that are encoded and generated by the encoding unit 14. The control unit 16 regulates variable delay units (not shown) that are inserted in appropriate positions so that access units and frames are input into each block at the correct timing. In FIG. 7, variable delay units are omitted for simplification of explanation.

The text below now explains how the control unit 16 controls the first router unit 11A, the second router unit 11B, the mixing unit 13, and the encoding unit 14.

The first stream A that is input into the first router unit 11A is input into either the stream switching unit 15 or the first decoding unit 12A. The first stream A that is input into the stream switching unit 15 is directly output as stream C without being re-encoded. Similarly, the second stream B that is input into the second router unit 11B is input into either the stream switching unit 15 or the second decoding unit 12B. The second stream B that is input into the stream switching unit 15 is directly output as stream C without being re-encoded.

Since the first stream A and the second stream B are encoded by overlap transform, of the first stream A and the second stream B, the access units that are re-encoded and the access units located anterior and posterior thereto are decoded by the first decoding unit 12A and the second decoding unit 12B. As explained in reference to mode of embodiment 1, a specified number of access units are mixed in the mixing unit 13, using a specified method. Here, the specified method is assumed to the cross-fading. The mixed frames are re-encoded by the encoding unit 14 and they are output to the stream switching unit 15.

The control unit 16 regulates the assignment of bits in the encoding unit 14 so that the generated streams that are output in sequence from the stream switching unit 15 satisfies the buffer management constraints that were explained in reference to mode of embodiment 1. In addition, the first decoding unit 12A and the second decoding unit 12B provide information on the type of window function employed and the length of a window to the control unit 16. Using this information, the control unit 16 may control the encoding unit 14 so that window functions are joined smoothly between the access units that are re-encoded and the access units that are not re-encoded. By an appropriately controlled variable delay unit (not shown), at any given time access units in only one input are input into the stream switching unit 15. The stream switching unit 15 outputs the input access units without modifying them.

Figure 8:
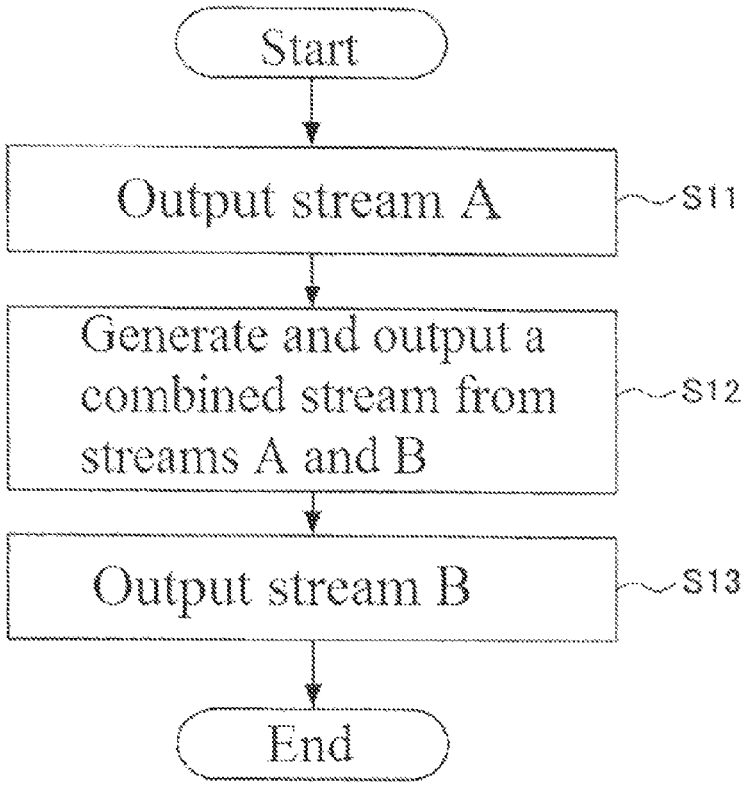
[FIG. 8] is a flowchart explaining the operation executed by the stream combining apparatus of FIG. 7.

FIG. 8 is a flowchart depicting the processing executed by the stream combining apparatus 20 of the present mode of embodiment under the control of the control unit 16, wherein stream C is generated by joining streams A and B. FIG. 9 shows pseudo-code for the execution of the processing in FIG. 8. The text below provides a detailed description of the processing executed by the stream combining apparatus 20 of the present mode of embodiment, with references to FIGS. 8 and 9.

In Step S11, the part of stream A which is not re-encoded is output as stream C. Specifically, the control unit 16, by controlling the first router unit 11A and the stream switching unit 15, outputs as is the part in stream A which is not re-encoded as stream C.

In the pseudo code in FIG. 9, the following program is executed:

// pass through Stream A $$(U_0^C, U_1^C, \ldots, U_{N^A-M-1}^C) = (U_0^A, U_1^A, \ldots, U_{N^A-M-1}^A) \quad \text{[Eq. 4]}$$

where it is assumed that streams A and B have $N^B$ audio frames, that is, $N^A+1$ and $N^B+1$ access units.

Stream X a stream that belongs to a set of elements consisting of streams A, B, and C; an access unit in stream X is denoted as $U_i^X$ ($0 \le i \le N^X-1$).

Next, in Step S12, a joint stream is generated and output from streams A and B. Specifically, the control unit 16 controls the first router unit 11A, the second router unit 11B, the first decoding unit 12A, the second decoding unit 12B, the mixing unit 13, the encoding unit 14, and the stream switching unit 15. As was explained in reference to FIG. 5, the control unit decodes the (M+2) access units extracted from streams A and B, generates M audio frames, cross-fades M audio frames out of them, re-encodes (M+2) joint audio frames, generates (M+1) joint access units, and outputs the results as stream C.

In the pseudo-code of FIG. 9, the following program is executed:

// re encode A-B mixed frames $$(F_{N^A-M-1}^A, F_{N^A-M}^A, \ldots, F_{N^A-1}^A) = dec(U_{N^A-M-1}^A, U_{N^A-M}^A, \ldots, U_{N^A}^A)$$

$$F_0^B, F_1^B, \ldots, F_M^B) = dec(U_0^B, U_1^B, \ldots, U_{M+1}^B)$$

$$(F_0^{AB}, F_1^{AB}, \ldots, F_{M-1}^{AB}) = \mathrm{mix}((F_{N^A-M}^A, F_{N^A-M+1}^A, \ldots, F_{N^A-1}^A), F_0^B, F_1^B, \ldots, F_{M-1}^B))$$

$$(U_{N^A-M}^C, U_{N^A-M+1}^C, \ldots, U_{N^A}^C) = enc(F_{N^A-M-1}^A, F_0^{AB}, F_1^{AB}, \ldots, F_{M-1}^{AB}, F_M^B) \quad \text{[Eq. 5]}$$

In this case, stream C ends up having $N^C = N^A + N^B - M$ audio frames, that is, $N^C+1$ access units. Further, an audio frame in stream C is denoted as $F_i^X$.

The function mix $((F_0, F_1, \ldots, F_{N-1}), (F'_0, F'_1, \ldots, F'_{N-1}))$ represents a vector of N audio frames which is the cross-fading of a vector of 2 sets of N audio frames. The function dec $(U_0, U_1, \ldots, U_N)$ represents a vector $(F_0, F_1, \ldots, F_{N-1})$ of N audio frames which is the decoding of a vector of N+1 access units. The function enc $(F_{-1}, F_0, \ldots, F_N)$ represents N+1 access units $(U_0, U_1, \ldots, U_N)$ which is the encoding of a vector of N+2 audio frames.

The function enc ( . . . ) re-encodes M+2 audio frames and generates M+1 access units. In this case, to maintain continuity of buffer state between the re-encoded stream and the stream that is not re-encoded, in addition to the condition that the re-encoded stream does not overflow or underflow, the following buffer constraints must be met:

The initial buffer utilization amount and the final buffer utilization amount of the re-encoded stream (called stream AB) must be equal, respectively, to the buffer utilization amount of the last access unit in the non-re-encoded stream A and the last access unit in the re-encoded stream B. In other words, if the buffer utilization amount after the access unit $U_i^X$ is removed from the buffer is denoted by $S_i^X$, the following relationships must hold:

$$S_{-1}^{AB} = S_{N_A-M-1}^A \quad \text{[Eq. 6]}$$

and $$S_M^{AB} = S_M^B \quad \text{[Eq. 7]}$$

The average encoding amount per access unit in a re-encoded stream will be:

$$\bar{L}^{AB} = \bar{L} - \Delta S^{AB}/(M+1) \quad \text{[Eq. 8]}$$

where $$\Delta S^{AB} = S_M^{AB} - S_{-1}^{AB} = S_M^B - S_{N_A-M\ 1}^A \quad \text{[Eq. 9]}$$

"L" (with an upper score) denotes the average encoding amount per access unit in stream A or B.

$$|\Delta S^{AB}| \le S^{max} \quad \text{[Eq. 10]}$$

Therefore, by increasing the value of M, we obtain $$\bar{L}^{AB} \approx \bar{L} \quad \text{[Eq. 11]}$$

Therefore, it is clear that by making M sufficiently large, a rate control that guarantees the satisfying of buffer management constraints can be achieved.

In order to make the average encoding amount for access units in a stream to be re-encoded equal to L (with an upper score)$^{AB}$, it suffices to assign, for example, an encoding amount equal to L (with an upper score)$^{AB}$. In some cases, however, it is not possible to assign the same encoding amount to all access units. In such a case, the assignment of encoding amounts can be varied or a padding can be inserted to make adjustments so that the average encoding amount is equal to L (with an upper score)$^{4B}$.

Next, in Step S13, the part of stream B that is not re-encoded is output. In pseudo-code of FIG. 9 the following program is executed:

// pass through Stream B $$(U_{N^A+1}{}^C, U_{N^A+2}{}^C, \ldots, U_{N^A+N^B-M}{}^C) = (U_{M+1}{}^B, U_{M+2}{}^B, \ldots, U_{N^B}{}^B) \quad \text{[Eq. 12]}$$

Specifically, the control unit 16 controls the second router unit 11B and the stream switching unit 15, and outputs the part of stream B which is not re-encoded, as is, as stream C.

As explained above, in the stream combining apparatus 10 of the present mode of embodiment, as the first stream A and the second strewn B, contiguous group 1 access units and contiguous group 2 access units that are input into the first router unit 11A and the second router unit 11B are decoded by the first decoding unit 12A and the second decoding unit 12B, thereby generating contiguous group 1 frames and contiguous group 2 frames thus generated, based upon the access units that are used to decode the frames. The encoding unit 14 encodes said mixed frames, and group 3 access units that provide a joint for the two streams. Therefore, the need for decoding all compressed data into frames and re-encoding them, that is, the re-encoding step, is eliminated. Further, the stream switching unit 15, using a prescribed number of group 3 access units thus generated as a joint, performs the joining so that at the boundary between the two streams and a prescribed number of group 3 access units the adjacent access units share the information for the decoding of the same common frames; and generates a third stream C. Therefore, even when not all compressed data is decoded into frames and re-encoded, a smooth joint free of any artifacts can be produced The above is a detailed description of preferred modes of embodiment of the present invention. The present invention, however, is not limited to such specific modes of embodiment; it can be altered and modified in various ways within the scope of the present invention described in the claims. Although the above modes of embodiment described cases where audio compressed data generated according to RAC was used, the present invention is applicable to any compressed data that is generated by overlap transform. In addition, the stream combining apparatus of the present invention can be operated by a stream combining program that causes the general-purpose computer including the CPU and memory, to function as the above-described means; the stream combining program can be distributed via communication circuits, and it can also be distributed in the form of CD-ROM and other recording media.

EXPLANATION OF CODES

1. input unit
2. decoding unit
3. combining unit
10. stream combining apparatus
11A. first router unit
11B. second router unit
12A. first decoding unit
12B. second decoding unit
13. mixing unit
14. encoding unit
15. stream switching unit
16. controller
20. stream combining apparatus

What is claimed is:

1. An audio stream combining apparatus that generates one audio stream by joining two audio streams composed of compressed data that is generated by overlap transform;

wherein the access units that serve as units of decoding of said two audio streams are designated as group 1 access units and group 2 access units, respectively; wherein the frames that are produced by decoding said two audio streams are designated as group 1 frames and group 2 frames, respectively; and wherein the access units that are produced by encoding the mixed frames that are generated by mixing said group 1 frames and group 2 frames are designated as group 3 access units; wherein said audio stream combining apparatus comprises:

an input unit that receives the input of group 1 access units and group 2 access units;

a decoding unit that generates via a processor group 1 frames by decoding the group 1 access units that are input by said input unit and group 2 frames by decoding said group 2 access units; and a combining unit using the access units employed to decode the frames as a frame of reference, that via the processor selectively mixes the plurality of group 1 frames and the plurality of group 2 frames decoded by said decoding unit, that generates mixed frames, that generates prescribed number of group 3 access units by encoding said mixed frames, and that joins said plurality of group 1 frames and said plurality of group 2 frames, using said prescribed number of group 3 access units as a joint, such that the access units adjacent to one another at the boundary between said plurality of group 1 access units, said plurality of group 2 access units, and said prescribed number of group 3 access units share the information for the decoding of the same common frames, wherein said combining unit comprises an encoding unit that mixes, of said plurality of group 1 frames, a prescribed number of group 1 frames including the end frame, and of said plurality of group 2 frames, a prescribed number of group 2 frames including the starting frame, so that the frames, exclusive of one or more frame from the beginning of said prescribed number of group 1 frames and one or more frame from the end of said prescribed number of group 2 frames, overlap one another; that generates mixed frames greater in numbers than said prescribed number; that encodes said mixed frames; and that generates a prescribed number of group 3 access units.

2. The audio stream combining apparatus of claim 1, wherein said combining unit comprises a joining unit that joins said plurality of group 1 access units and said prescribed number of group 3 access units such that the starting access unit of the plurality of access units used to decode said prescribed number of group 1 frames and the starting access unit of said prescribed number of group 3 access units are adjacent to each other; and that joins said plurality of group 2 access units and said prescribed number of group 3 access units such that the end access unit of the plurality of access units used to decode said prescribed number of group 2 frames and the end access unit of said prescribed number of group 3 access units are adjacent to each other.

3. The audio stream combining apparatus of claim 1, wherein said combining unit comprises a mixing unit that mixes said group 1 frames and said group 2 frames by cross-fading them.

4. The audio stream combining apparatus of claim 1, wherein said group 1 access units and said group 2 access units are input at the same transmission rate and sampling frequency.

5. The audio stream combining apparatus of claim 1, wherein said group 1 access units and said group 2 access units are in the ADTS (Audio Data Transport Stream) frame format.

6. An audio stream combining apparatus that generates one audio stream by joining two audio streams composed of compressed data that is generated by overlap transform;

wherein the access units that serve as units of decoding of said two audio streams are designated as group 1 access units and group 2 access units, respectively; wherein the frames that are produced by decoding said two audio streams are designated as group 1 frames and group 2 frames, respectively; and wherein the access units that are produced by encoding the mixed frames that are generated by mixing said group 1 frames and group 2 frames are designated as group 3 access units; wherein said audio stream combining apparatus comprises:

an input unit that receives the input of group 1 access units and group 2 access units;

a decoding unit that generates via a processor group 1 frames by decoding the group 1 access units that are input by said input unit and group 2 frames by decoding said group 2 access units; and a combining unit using the access units employed to decode the frames as a frame of reference, that via the processor selectively mixes the plurality of group 1 frames and the plurality of group 2 frames decoded by said decoding unit, that generates mixed frames, that generates prescribed number of group 3 access units by encoding said mixed frames, and that joins said plurality of group 1 frames and said plurality of group 2 frames, using said prescribed number of group 3 access units as a joint, such that the access units adjacent to one another at the boundary between said plurality of group 1 access units, said plurality of group 2 access units, and said prescribed number of group 3 access units share the information for the decoding of the same common frames, wherein said combining unit comprises a joining unit that joins said plurality of group 1 access units and said prescribed number of group 3 access units such that the starting access unit of the plurality of access units used to decode said prescribed number of group 1 frames and the starting access unit of said prescribed number of group 3 access units are adjacent to each other; and that joins said plurality of group 2 access units and said prescribed number of group 3 access units such that the end access unit of the plurality of access units used to decode said prescribed number of group 2 frames and the end access unit of said prescribed number of group 3 access units are adjacent to each other, wherein said encoding unit encodes said group 3 access units such that the initial buffer utilization amount and the final utilization amount of said prescribed number group 3 access units match, respectively, the buffer utilization amount of the leading access units of the plurality of access units employed to decode said prescribed number of group 1 frames and the buffer utilization amount of the end access units of said plurality of access units employed to decode said prescribed number of group 2 frames.

7. An audio stream combining method that generates one audio stream by joining two audio streams composed of compressed data that is generated by overlap transform;

wherein the access units that serve as units of decoding of said two audio streams are designated as group 1 access units and group 2 access units, respectively; wherein the frames that are produced by decoding said two audio streams are designated as group 1 frames and group 2 frames, respectively; and wherein the access units that are produced by encoding the mixed frames that are generated by mixing said group 1 frames and said group 2 frames are designated as group 3 access units; wherein said audio stream combining method comprises:

an input step that inputs group 1 access units and group 2 access units;

a decoding step that generates, via a decoder, group 1 frames by decoding the group 1 access units that are input in said input step and that generates group 2 frames by decoding said group 2 access units;

a combining step that selectively mixes, via a processor, said plurality of said group 1 frames and a plurality of group 2 frames decoded in said decoding step, using the access units employed to decode the frames as a frame of reference, and that generates a prescribed number of group 3 access units;

and that joins said plurality of group 1 access units and said plurality of group 2 access units, such that, using said prescribed number of group 3 access units as a joint, the information for the decoding of the same common frames is shared by access units that are adjacent to one another across the boundary between said plurality of group 1 access units, said plurality of group 2 access units, and said prescribed number of group 3 access units; and an outputting step that outputs the mixed plurality of frames and the generated group 3 access units, wherein said combining step comprises an encoding unit that mixes, of said plurality of group 1 frames, a prescribed number of group 1 frames including the end frame, and of said plurality of group 2 frames, a prescribed number of group 2 frames including the starting frame, so that the frames, exclusive of one or more frame from the beginning of said prescribed number of group 1 frames and one or more frame from the end of said prescribed number of group 2 frames, overlap one another; that generates mixed frames greater in numbers than said prescribed number; that encodes said mixed frames; and that generates a prescribed number of group 3 access units.

8. The audio stream combining method of claim 7, wherein said combining step comprises joining said plurality of group 1 access units and said prescribed number of group 3 access units such that the starting access unit of the plurality of access units used to decode said prescribed number of group 1 frames and the starting access unit of said prescribed number of group 3 access units are adjacent to each other; and joining said plurality of group 2 access units and said prescribed number of group 3 access units such that the end access unit of the plurality of access units used to decode said prescribed number of group 2 frames and the end access unit of said prescribed number of group 3 access units are adjacent to each other.

9. The audio stream combining method of claim 7, wherein said combining comprises mixing said group 1 frames and said group 2 frames by cross-fading them.

10. The audio stream combining method of claim 7, wherein said group 1 access units and said group 2 access units are input at the same transmission rate and sampling frequency.

11. The audio stream combining method of claim 7, wherein said group 1 access units and said group 2 access units are in the ADTS (Audio Data Transport Stream) frame format.

12. A non-transitory computer readable medium storing an audio stream combining program that causes the computer to execute the processing of generating one audio stream by joining two audio streams composed of compressed data that is generated by overlap transform;

wherein the access units that serve as units of decoding of said two audio streams are designated as group 1 access units and group 2 access units, respectively; wherein the frames that are produced by decoding said two audio streams are designated as group 1 frames and group 2 frames, respectively; and wherein the access units that are produced by encoding the mixed frames that are generated by mixing said group 1 frames and group 2 frames are designated as group 3 access units; wherein said audio stream combining program comprises:

an input step that inputs group 1 access units and group 2 access units;

a decoding step that generates group 1 frames by decoding the group 1 access units that are input in said input step and that generates group 2 frames by decoding said group 2 access units; and a combining step that selectively mixes said plurality of said group 1 frames and a plurality of group 2 frames decoded in said decoding step, using the access units employed to decode the frames as a frame of reference, and that generates a prescribed number of group 3 access units;

and that joins said plurality of group 1 access units and said plurality of group 2 access units, such that, using said prescribed number of group 3 access units as a joint, the information for the decoding of the same common frames is shared by access units that are adjacent to one another across the boundary between said plurality of group 1 access units, said plurality of group 2 access units, and said prescribed number of group 3 access units, wherein said combining step comprises an encoding unit that mixes, of said plurality of group 1 frames, a prescribed number of group 1 frames including the end frame, and of said plurality of group 2 frames, a prescribed number of group 2 frames including the starting frame, so that the frames, exclusive of one or more frame from the beginning of said prescribed number of group 1 frames and one or more frame from the end of said prescribed number of group 2 frames, overlap one another; that generates mixed frames greater in numbers than said prescribed number; that encodes said mixed frames; and that generates a prescribed number of group 3 access units.

13. The computer readable medium of claim 12, wherein said combining step comprises joining said plurality of group 1 access units and said prescribed number of group 3 access units such that the starting access unit of the plurality of access units used to decode said prescribed number of group 1 frames and the starting access unit of said prescribed number of group 3 access units are adjacent to each other; and joining said plurality of group 2 access units and said prescribed number of group 3 access units such that the end access unit of the plurality of access units used to decode said prescribed number of group 2 frames and the end access unit of said prescribed number of group 3 access units are adjacent to each other.

14. The computer readable medium of claim 12, wherein said combining comprises mixing said group 1 frames and said group 2 frames by cross-fading them.

15. The computer readable medium of claim 12, wherein said group 1 access units and said group 2 access units are input at the same transmission rate and sampling frequency.

16. The computer readable medium of claim 12, wherein said group 1 access units and said group 2 access units are in the ADTS (Audio Data Transport Stream) frame format.

17. An audio stream combining method that generates one audio stream by joining two audio streams composed of compressed data that is generated by overlap transform;

wherein the access units that serve as units of decoding of said two audio streams are designated as group 1 access units and group 2 access units, respectively; wherein the frames that are produced by decoding said two audio streams are designated as group 1 frames and group 2 frames, respectively; and wherein the access units that are produced by encoding the mixed frames that are generated by mixing said group 1 frames and said group 2 frames are designated as group 3 access units; wherein said audio stream combining method comprises:

an input step that inputs group 1 access units and group 2 access units;

a decoding step that generates, via a decoder, group 1 frames by decoding the group 1 access units that are input in said input step and that generates group 2 frames by decoding said group 2 access units;

a combining step that selectively mixes, via a processor, said plurality of said group 1 frames and a plurality of group 2 frames decoded in said decoding step, using the access units employed to decode the frames as a frame of reference, and that generates a prescribed number of group 3 access units;

and that joins said plurality of group 1 access units and said plurality of group 2 access units, such that, using said prescribed number of group 3 access units as a joint, the information for the decoding of the same common frames is shared by access units that are adjacent to one another across the boundary between said plurality of group 1 access units, said plurality of group 2 access units, and said prescribed number of group 3 access units, wherein said joining joins said plurality of group 1 access units and said prescribed number of group 3 access units such that the starting access unit of the plurality of access units used to decode said prescribed number of group 1 frames and the starting access unit of said prescribed number of group 3 access units are adjacent to each other; and that joins said plurality of group 2 access units and said prescribed number of group 3 access units such that the end access unit of the plurality of access units used to decode said prescribed number of group 2 frames and the end access unit of said prescribed number of group 3 access units are adjacent to each other, wherein said encoding encodes said group 3 access units such that the initial buffer utilization amount and the final utilization amount of said prescribed number group 3 access units match, respectively, the buffer utilization amount of the leading access units of the plurality of access units employed to decode said prescribed number of group 1 frames and the buffer utilization amount of the end access units of said plurality of access units employed to decode said prescribed number of group 2 frames.

18. A non-transitory computer readable medium storing an audio stream combining program that causes the computer to execute the processing of audio stream combining that generates one audio stream by joining two audio streams composed of compressed data that is generated by overlap transform;

wherein the access units that serve as units of decoding of said two audio streams are designated as group 1 access units and group 2 access units, respectively; wherein the frames that are produced by decoding said two audio streams are designated as group 1 frames and group 2 frames, respectively; and wherein the access units that are produced by encoding the mixed frames that are generated by mixing said group 1 frames and said group 2 frames are designated as group 3 access units; wherein said audio stream combining method comprises:

an input step that inputs group 1 access units and group 2 access units;

a decoding step that generates group 1 frames by decoding the group 1 access units that are input in said input step and that generates group 2 frames by decoding said group 2 access units;

a combining step that selectively mixes said plurality of said group 1 frames and a plurality of group 2 frames decoded in said decoding step, using the access units employed to decode the frames as a frame of reference, and that generates a prescribed number of group 3 access units;

and that joins said plurality of group 1 access units and said plurality of group 2 access units, such that, using said prescribed number of group 3 access units as a joint, the information for the decoding of the same common frames is shared by access units that are adjacent to one another across the boundary between said plurality of group 1 access units, said plurality of group 2 access units, and said prescribed number of group 3 access units, wherein said joining joins said plurality of group 1 access units and said prescribed number of group 3 access units such that the starting access unit of the plurality of access units used to decode said prescribed number of group 1 frames and the starting access unit of said prescribed number of group 3 access units are adjacent to each other; and that joins said plurality of group 2 access units and said prescribed number of group 3 access units such that the end access unit of the plurality of access units used to decode said prescribed number of group 2 frames and the end access unit of said prescribed number of group 3 access units are adjacent to each other, wherein said encoding encodes said group 3 access units such that the initial buffer utilization amount and the final utilization amount of said prescribed number group 3 access units match, respectively, the buffer utilization amount of the leading access units of the plurality of access units employed to decode said prescribed number of group 1 frames and the buffer utilization amount of the end access units of said plurality of access units employed to decode said prescribed number of group 2 frames.

* * * * *